US005507844A

United States Patent [19]

Lin et al.

[11] Patent Number: 5,507,844

[45] Date of Patent: Apr. 16, 1996

[54] FUEL COMPOSITIONS

[75] Inventors: Jiang-Jen Lin; Sarah L. Weaver, both of Houston, Tex.

[73] Assignee: Shell Oil Company, Houston, Tex.

[21] Appl. No.: 491,795

[22] Filed: Jun. 19, 1995

[51] Int. Cl.[6] ..... C10L 1/18; C10L 1/22

[52] U.S. Cl. ..... 44/340

[58] Field of Search ..... 44/329, 340, 342

[56] References Cited

U.S. PATENT DOCUMENTS

| | | | |
|---|---|---|---|
| 2,864,676 | 12/1958 | Thompson | 44/340 |
| 3,894,041 | 7/1975 | Otsuki et al. . | |
| 4,280,894 | 7/1981 | Taylor | 208/15 |
| 4,342,688 | 8/1982 | Tappe . | |
| 4,612,335 | 9/1986 | Cuscurida et al. . | |
| 4,814,462 | 3/1989 | Kurata et al. | 548/444 |
| 4,883,826 | 11/1989 | Marugg et al. . | |
| 4,973,414 | 11/1990 | Nerger et al. . | |
| 5,123,932 | 6/1992 | Rath et al. . | |

FOREIGN PATENT DOCUMENTS

| | | |
|---|---|---|
| 181140 | 10/1985 | European Pat. Off. . |
| 63-280791A | 5/1987 | Japan . |

OTHER PUBLICATIONS

Chemical Abstract 112:141779, 1989.

*Primary Examiner*—Prince Willis, Jr.
*Assistant Examiner*—Cephia D. Toomer

[57] ABSTRACT

The present invention is directed to the use of phenyl substituted, five member aromatic amine alkoxylate compounds as additives in fuel compositions. The invention is also directed to the use of these compounds for decreasing intake valve deposits.

12 Claims, No Drawings

FUEL COMPOSITIONS

FIELD OF THE INVENTION

The present invention relates to the use of phenyl substituted, five member aromatic amine alkoxylate compounds as additives in fuel compositions and the use of these compounds to decrease intake valve deposits.

BACKGROUND OF THE INVENTION

The accumulation of deposits on the intake valves of internal combustion engines presents a variety of problems in today's engines. The accumulation of such deposits is characterized by overall poor driveability including hard starting, stalls, and stumbles during acceleration and rough engine idle.

Many additives are known which can be added to hydrocarbon fuels to prevent or reduce deposit formation, or remove or modify formed deposits, in the combustion chamber and on adjacent surfaces such as intake valves, ports, and spark plugs. Continued improvements in the design of internal combustion engines, e.g., fuel injection and carburetor engines, bring changes to the environment of such engines thereby creating a continuing need for new additives to control the problem of inlet system deposits and to improve driveability which can be related to deposits.

It would be an advantage to have fuel compositions which would reduce the formation of deposits and modify existing deposits that are related to octane requirement increase and poor driveability in modern engines which burn hydrocarbon fuels.

SUMMARY OF THE INVENTION

The present invention is directed to the use of phenyl substituted, five member aromatic amine alkoxylates as additives in fuel compositions comprising a major amount of a mixture of hydrocarbons in the gasoline boiling range and a minor amount of one or more of the compounds of Formula I:

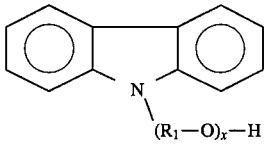

(I)

wherein each $R_1$ is independently selected from the group consisting of alkyl of 2 to 20 carbon atoms, x is from 4 to 50 and the weight average molecular weight of the additive compound is at least about 600.

The invention is also directed to the use of these compounds for decreasing intake valve deposits.

DESCRIPTION OF THE PREFERRED EMBODIMENTS

COMPOUNDS

The compounds of the present invention, broadly expressed as phenyl substituted, five member aromatic amine alkoxylates are a new class of additives useful for hydrocarbon fuels, e.g., fuels in the gasoline boiling range for preventing deposits in engines. The compounds produce very little residue and are miscible with carriers and other detergents. Non-limiting illustrative embodiments of the compounds useful as additives in the instant invention include those of Formula I:

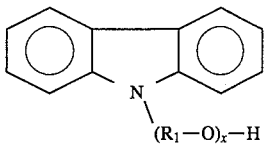

(I)

In Formula I, each $R_1$ is independently selected from alkyl of 2 to 20 carbon atoms. Preferably each $R_1$ is independently selected from alkyl of 2 to 12 carbon atoms. In the more preferred embodiments of the present invention, $R_1$ is alkyl of 2 to 4 carbon atoms and in the most preferred embodiments, $R_1$ is alkyl of 4 carbon atoms.

Particularly preferred compounds of Formula I are those in which $R_1$ is alkyl (geminal or vicinal) of formula:

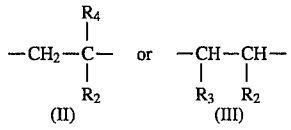

(II) (III)

wherein $R_2$, $R_3$ and $R_4$ are each independently hydrogen or alkyl of 1 to 18 carbon atoms. $R_4$ and $R_2$, or alternatively $R_2$ and $R_3$, may be taken together to form a divalent linking alkyl group of 3 to 12 carbon atoms.

The most preferred compounds of Formula I are those in which $R_1$ is alkyl as represented by Formula II above wherein $R_4$ is hydrogen and $R_2$ is independently hydrogen or alkyl of 1 to 18 carbon atoms, particularly those compounds where $R_4$ is hydrogen and $R_2$ is independently hydrogen or alkyl of 1 to 2 carbon atoms, especially those compounds where $R_4$ is hydrogen and $R_2$ is alkyl of two carbon atoms.

In Formula I, x is from 4 to 50, preferably from 6 to 40 and more preferably from 6 to 25. Compounds in which x is from 10 to 22 are especially preferred. Those of ordinary skill in the art will recognize that when the compounds of Formula I are utilized in a composition, x will not have a fixed value but will instead be represented by a range of different values. As used in this specification, x is considered to be a (number) average of the various values of x that are found in a given composition, which number has been rounded to the nearest integer. This is indicated in the various examples by the polydispersity (polydispersity= molecular weight based on the weight average divided by the molecular weight based on the number average).

The individual $R_1$'s can be the same or different. For example, if x is 20, each $R_1$ can be alkyl of four carbon atoms. Alternatively, the $R_1$'s can differ and for instance, independently be alkyl from two to four carbon atoms. When the $R_1$'s differ, they may be present in blocks, i.e., all x groups in which $R_1$ is alkyl of three carbon atoms will be adjacent, followed by all x groups in which $R_1$ is alkyl of two carbon atoms, followed by all x groups in which $R_1$ is alkyl of four carbon atoms. When the $R_1$'s differ, they may also be present in any random distribution.

The compounds of Formula I have a total weight average molecular weight of at least 600. Preferably, the total weight average molecular weight is from about 800 to about 4000, even more preferably from about 800 to about 2000, most preferably from about 1100 to about 1700.

The compounds of Formula I are illustratively prepared by alkoxylation, i.e., reacting carbazole with one or more epoxides in the presence of a potassium compound.

The one or more epoxides employed in the reaction with the initiators to prepare the compounds of Formula I contain from 2 to 100 carbon atoms, preferably from 2 to 50 carbon atoms, more preferably from 2 to 20 carbon atoms, even more preferably from 2 to 4 carbon atoms. The epoxides may be internal epoxides such as 2,3 epoxides of Formula IV:

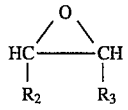

(IV)

wherein $R_2$ and $R_3$ are as defined hereinbefore or terminal epoxides such as 1,2 epoxides of Formula V:

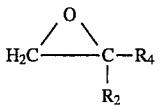

(V)

wherein $R_1$ and $R_4$ are as defined hereinbefore. In both Formulas IV and V, $R_3$ and $R_2$, or alternatively $R_2$ and $R_4$, may be taken together to form a cycloalkylene epoxide or a vinylidene epoxide by forming a divalent linking hydrocarbyl group of 3 to 12 carbon atoms.

In the preferred embodiment, the terminal epoxides represented by Formula V are utilized. Ideally these terminal epoxides are 1,2-epoxyalkanes. Suitable 1,2-epoxyalkanes include 1,2-epoxyethane, 1,2-epoxypropane, 1,2-epoxybutane, 1,2-epoxydecane, 1,2-epoxydodecane, 1,2-epoxyhexadecane, 1,2-epoxyoctadecane and mixtures thereof.

In a typical preparation of Formula I compounds, the one or more epoxides and initiator are contacted at a ratio from about 7:1 to about 55:1 moles of epoxide per mole of initiator. Preferably, they are contacted at a molar ratio from about 10:1 to about 30:1, with the most preferred molar ratio being about 20:1.

The reaction is carried out in the presence of potassium compounds which act as alkoxylation catalysts. Such catalysts are conventional and include potassium methoxide, potassium ethoxide, potassium hydroxide, potassium hydride and potassium-t-butoxide. The preferred catalysts are potassium hydroxide and potassium-t-butoxide. The catalysts are used in a base stable solvent such as alcohol, ether or hydrocarbons. The catalysts are employed in a wide variety of concentrations. Generally, the potassium compounds will be used in an amount from about 0.02% to about 5.0% of the total weight of the mixture, preferably from about 0.1% to about 2.0% of the total weight of the mixture, and most preferably about 0.2% of the total weight of the mixture.

The reaction is conveniently carried out in a conventional autoclave reactor equipped with heating and cooling means. The process is practiced batchwise, continuously or semi-continuously.

The manner in which the alkoxylation reaction is conducted is not critical to the invention. Illustratively, the initiator and potassium compound are mixed and heated under vacuum for a period of at least 30 minutes. The one or more epoxides are then added to the resulting mixture, the reactor sealed and pressurized with nitrogen, and the mixture stirred while the temperature is gradually increased.

The temperature range for alkoxylation is from about 80° C. to about 180° C., preferably from about 100° C. to about 150° C., and even more preferably from about 120° C. to about 140° C. The alkoxylation reaction time is generally from about 2 to about 20 hours, although longer or shorter times are employed.

Alkoxylation processes of the above type are known and are described, for example in U.S. Pat. No. 4,973,414, U.S. Pat. No. 4,883,826, U.S. Pat. No. 5,123,932 and U.S. Pat. No. 4,612,335, each incorporated herein by reference.

The product of Formula I is normally liquid and is recovered by conventional techniques such as filtration and distillation. The product is used in its crude state or is purified, if desired, by conventional techniques such as aqueous extraction, solid absorption and/or vacuum distillation to remove any remaining impurities.

FUEL COMPOSITIONS

The compounds of Formula I are useful as additives in fuel compositions which are burned or combusted in internal combustion engines. The fuel compositions of the present invention comprise a major amount of a mixture of hydrocarbons in the gasoline boiling range and a minor amount of one or more of the compounds of Formula I. As used herein, the term "minor amount" means less than about 10% by weight of the total fuel composition, preferably less than about 1% by weight of the total fuel composition and more preferably less than about 0.1% by weight of the total fuel composition.

Suitable liquid hydrocarbon fuels of the gasoline boiling range are mixtures of hydrocarbons having a boiling range of from about 25° C. to about 232° C. and comprise mixtures of saturated hydrocarbons, olefinic hydrocarbons and aromatic hydrocarbons. Preferred are gasoline mixtures having a saturated hydrocarbon content ranging from about 40% to about 80% by volume, an olefinic hydrocarbon content from 0% to about 30% by volume and an aromatic hydrocarbon content from about 10% to about 60% by volume. The base fuel is derived from straight run gasoline, polymer gasoline, natural gasoline, dimer and trimerized olefins, synthetically produced aromatic hydrocarbon mixtures, or from catalytically cracked or thermally cracked petroleum stocks, and mixtures of these. The hydrocarbon composition and octane level of the base fuel are not critical. The octane level, (R+M)/2, will generally be above about 85.

Any conventional motor fuel base can be employed in the practice of the present invention. For example, hydrocarbons in the gasoline can be replaced by up to a substantial amount of conventional alcohols or ethers, conventionally known for use in fuels. The base fuels are desirably substantially free of water since water could impede a smooth combustion.

Normally, the hydrocarbon fuel mixtures to which the invention is applied are substantially lead-free, but may contain minor amounts of blending agents such as methanol, ethanol, ethyl tertiary butyl ether, methyl tertiary butyl ether, and the like, at from about 0.1% by volume to about 15% by volume of the base fuel, although larger amounts may be utilized. The fuels can also contain conventional additives including antioxidants such as phenolics, e.g., 2,6-di-tert-butylphenol or phenylenediamines, e.g., N,N'-di-sec-butyl-p-phenylenediamine, dyes, metal deactivators, dehazers such as polyester-type ethoxylated alkylphenol-formaldehyde resins. Corrosion inhibitors, such as a polyhydric alcohol ester of a succinic acid derivative having on at least one of its alphacarbon atoms an unsubstituted or substituted aliphatic hydrocarbon group having from 20 to 500 carbon atoms, for example, pentaerythritol diester of polyisobutylene-substituted succinic acid, the polyisobutylene group having an average molecular weight of about 950, in an amount from about 1 ppm (parts per million) by weight to about 1000 ppm by weight, may also be present. The fuels can also contain antiknock compounds such as methyl cyclopentadienylmanganese tricarbonyl and orthoazidophenol as well as co-antiknock compounds such as benzoyl acetone.

An effective amount of one or more compounds of Formula I are introduced into the combustion zone of the engine in a variety of ways to prevent build-up of deposits, or to accomplish the reduction of intake valve deposits or the modification of existing deposits that are related to octane requirement. As mentioned, a preferred method is to add a minor amount of one or more compounds of Formula I to the fuel. For example, one or more compounds of Formula I are added directly to the fuel or are blended with one or more carriers and/or one or more additional detergents to form an additive concentrate which can then be added at a later date to the fuel.

The amount of phenyl substituted, five member aromatic amine alkoxylates used will depend on the particular variation of Formula I used, the engine, the fuel, and the presence or absence of carriers and additional detergents. Generally, each compound of Formula I is added in an amount up to about 1000 ppm by weight, especially from about 1 ppm by weight to about 600 ppm by weight based on the total weight of the fuel composition. Preferably, the amount will be from about 50 ppm by weight to about 400 ppm by weight, and even more preferably from about 75 ppm by weight to about 250 ppm by weight based on the total weight of the fuel composition.

The carrier, when utilized, will have a weight average molecular weight from about 500 to about 5000. Suitable carriers, when utilized, include hydrocarbon based materials such as polyisobutylenes (PIB's), polypropylenes (PP's) and poly-alphaolefins (PAO's); polyether based materials such as polybutylene oxides (poly BO's), polypropylene oxides (poly PO's), polyhexadecene oxides (poly HO's) and mixtures thereof (i.e., both (poly BO)+(poly PO) and (poly-BO-PO)); and mineral oils such as Exxon Naphthenic 900 sus and high viscosity index (HVI) oils. The carrier is preferably selected from PIB's, poly BO's, and poly PO's, with poly BO's being the most preferred.

The carrier concentration in the final fuel composition is up to about 1000 ppm by weight. When a carrier is present, the preferred concentration is from about 50 ppm by weight to about 400 ppm by weight, based on the total weight of the fuel composition. Once the carrier is blended with one or more compounds of Formula I, the blend is added directly to the fuel or packaged for future use.

The fuel compositions of the present invention may also contain one or more additional detergents. When additional detergents are utilized, the fuel composition will comprise a mixture of a major amount of hydrocarbons in the gasoline boiling range as described hereinbefore, a minor amount of one or more compounds of Formula I as described hereinbefore and a minor amount of one or more additional detergents. As noted above, a carrier as described hereinbefore may also be included. As used herein, the term "minor amount" means less than about 10% by weight of the total fuel composition, preferably less than about 1% by weight of the total fuel composition and more preferably less than about 0.1% by weight of the total fuel composition.

The one or more additional detergents are added directly to the hydrocarbons, blended with one or more carriers, blended with one or more compounds of Formula I, or blended with one or more compounds of Formula I and one or more carriers before being added to the hydrocarbons.

The concentration of the one or more additional detergents in the final fuel composition is generally up to about 1000 ppm by weight for each additional detergent. When one or more additional detergents are utilized, the preferred concentration for each additional detergent is from about 50 ppm by weight to about 400 ppm by weight, based on the total weight of the fuel composition, even more preferably from about 75 ppm by weight to about 250 ppm by weight, based on the total weight of the fuel composition.

ENGINE TESTS

Decreasing Intake Valve Deposits

The invention further provides a process for decreasing intake valve deposits in engines utilizing the compounds of the present invention. The process comprises supplying to and combusting or burning in an internal combustion engine a fuel composition comprising a major amount of hydrocarbons in the gasoline boiling range and a minor amount of one or more compounds of Formula I as described hereinbefore.

By supplying to and combusting or burning the fuel composition in an internal combustion engine, deposits in the induction system, particularly deposits on the tulips of the intake valves, are reduced. The reduction is determined by running an engine with clean induction system components and pre-weighed intake valves on dynamometer test stands in such a way as to simulate road operation using a variety of cycles at varying speeds while carefully controlling specific operating parameters. The tests are run for a specific period of time on the fuel composition to be tested. Upon completion of the test, the induction system deposits are visually rated, the valves are reweighed and the weight of the valve deposits is determined.

The ranges and limitations provided in the instant specification and claims are those which are believed to particularly point out and distinctly claim the instant invention. It is, however, understood that other ranges and limitations that perform substantially the same function in substantially the same way to obtain the same or substantially the same result are intended to be within the scope of the instant invention as defined by the instant specification and claims.

The invention will be further described by the following examples which are provided for illustrative purposes and are not to be construed as limiting the invention. Comparative examples are also included.

EXAMPLES

Compound Preparation

The compound of the present invention, exemplified by Example 1, was prepared by reacting carbazole with one or more epoxides in the presence of a potassium compound to produce compounds of Formula I having a weight average molecular weight from about 600 to about 4000. Weight average molecular weights (MW) were determined by gel permeation chromatography (GPC).

EXAMPLE 1

Carbazol (31 g, 0.19 moles), 1,2-epoxybutane (269 g, 3.7 moles) and potassium t-butoxide (1.7 g, 0.015 moles) were charged directly into a one liter autoclave reactor equipped with a heating device, temperature controller, mechanical stirrer and water cooling system. The autoclave reactor was purged of air with nitrogen and then pressurized to 50 psi with nitrogen at room temperature. The mixture was heated to a temperature of 127° C.–130° C. for 6.5 hours. During the process, the pressure readings ranged from 127–66 psi. The autoclave reactor was cooled to room temperature and excess gas was vented. The crude product was subjected to rotary evaporation under reduced pressure, extracted with water and then subjected to rotary evaporation again. GPC analysis of the final product showed a MW of 1280 and a polydispersity of 1.07.

EXAMPLE 2

Carbazol (31 g, 0.19 moles), 1,2-epoxybutane (269 g, 3.7 moles) and potassium t-butoxide (1.7 g, 0.015 moles) were charged directly into a one liter autoclave reactor equipped with a heating device, temperature controller, mechanical stirrer and water cooling system. The autoclave reactor was purged of air with nitrogen and then pressurized to 50 psi with nitrogen at room temperature. The mixture was heated to a temperature of 127° C.–130° C. for 5.0 hours. During the process, the pressure readings ranged from 127–66 psi. The autoclave reactor was cooled to room temperature and excess gas was vented. The crude product was subjected to rotary evaporation under reduced pressure, extracted with water and then subjected to rotary evaporation again. GPC analysis of the final product showed a MW of 1280 and a polydispersity of 1.07.

Comparative Example 1

Diethylamine (27 g, 0.37 moles), 1,2-epoxybutane (573 g, 7.96 moles) and potassium t-butoxide (1.7 g, 0.015 moles) were charged directly into a one liter autoclave reactor equipped with a heating device, temperature controller, mechanical stirrer and water cooling system. The autoclave reactor was purged of air with nitrogen and then pressurized to 50 psi with nitrogen at room temperature. The mixture was heated to a temperature of 120° C. for 11 hours. During the process, the pressure readings ranged from 139–80 psi. The autoclave reactor was cooled to room temperature and excess gas was vented. The crude product was subjected to rotary evaporation under reduced pressure, extracted with water and then subjected to rotary evaporation again. GPC analysis of the final product showed a MW of 4600 and a polydispersity of 1.58.

Comparative Example 2

N-methylaniline (40.1 g, 0.37 moles), 1,2-epoxybutane (560 g, 7.78 moles) and potassium t-butoxide (3.4 g, 0.030 moles) were charged directly into a one liter autoclave reactor equipped with a heating device, temperature controller, mechanical stirrer and water cooling system. The autoclave reactor was purged of air with nitrogen and then pressurized to 50 psi with nitrogen at room temperature. The mixture was heated to a temperature of 119°–125° C. for 7.0 hours. During the process, the pressure readings ranged from 132–66 psi. The autoclave reactor was cooled to room temperature and excess gas was vented. The crude product was subjected to rotary evaporation under reduced pressure, extracted with water and then subjected to rotary evaporation again. GPC analysis of the final product showed a MW of 1270 and a polydispersity of 1.31.

TEST RESULTS

In each of the following tests, the base fuel utilized comprised either premium unleaded gasoline (PU) (90+ octane, [R+M/2]) and/or regular unleaded gasoline (RU) (85–88 octane, [R+M/2]). Those skilled in the art will recognize that fuels containing heavy catalytically cracked stocks, such as most regular fuels, are typically more difficult to additize in order to control deposits and effectuate octane requirement reduction and octane requirement increase control. The compounds utilized were prepared as indicated by Example number and were used at the concentration indicated in ppm (parts per million) by weight. The tests employed are described below and the results of the various tests are set forth in the tables below.

INTAKE VALVE DEPOSIT TESTS

Engines from vehicles were installed in dynamometer cells in such a way as to simulate road operation using a cycle of idle, low speed and high speed components while carefully controlling specific operating parameters. Fuels with and without the compounds of Formula I were tested in a 2.3 L Ford (FORD) and a 3.3 L Dodge (DODGE), each having port fuel injection, to determine the effectiveness of the compounds of the present invention in reducing intake valve deposits ("L" refers to liter). Carbureted 0.359 L Honda generator engines were also utilized to determine the effectiveness of the compounds of the present invention in reducing intake valve deposits.

Before each test, the engine was inspected, the induction system components were cleaned and new intake valves were weighed and installed. The oil was changed and new oil and fuel filters, gaskets and spark plugs were installed.

In all engines except the Honda, the tests were run in cycles consisting of idle, 35 mph and 65 mph for a period of 100 hours unless indicated otherwise. In the Honda engines, the tests were run in cycles consisting of a no load idle mode for one minute followed by a three minute mode with a load at 3600 rpm's for a period of 40 hours unless indicated otherwise. At the end of each test, the intake valves were removed and weighed.

All tests of the compounds of the present invention were carried out with additive concentrations (the amount of Compound Example # used) of 200 ppm non-volatile matter (nvm). Base Fuel results which have 0 ppm additive are also included for comparison purposes. The base fuels are indicated by the absence of a Compound Example # (indicated in the Compound Example # column by "--").

TABLE 1

Intake Valve Deposits in Honda Generator Engines

| Compound Example # | Fuel | Concentration ppm By Wt | Engine | Avg. Deposit Wt. (mg) |
|---|---|---|---|---|
| 1 | PU | 200 | 2C | 1.0 |
| — | PU | 0 | 2C | 57.1 |
| 1 | PU | 200 | 3B | 24.8 |
| — | PU | 0 | 3B | 71.6 |
| 1 | PU | 200 | 4B | 18.3 |
| — | PU | 0 | 4B | 62.9 |
| 2 | RU | 200 | 2D | 30.9 |
| — | RU | 0 | 2D | 82.6 |

Indicates the results achieved with base fuel in the absence of any additive compound (0 ppm additive compound).

TABLE 2

Intake Valve Deposits in Various Engines

| Compound Example # | Engine | Fuel | Concentration ppm By Wt | Avg. Deposit Wt (mg) |
|---|---|---|---|---|
| 1 | FORD | PU | 200 | 57.8 |
| — | FORD | PU | 0 | 154.1 |
| 1 | DODGE | PU | 200 | 144.9 |
| — | DODGE | PU | 0 | 350.9 |

TABLE 2-continued

| Intake Valve Deposits in Various Engines | | | | |
|---|---|---|---|---|
| Compound Example # | Engine | Fuel | Concentration ppm By Wt | Avg. Deposit Wt (mg) |

— Indicates the results achieved with base fuel in the absence of any additive compound (0 ppm additive compound).

What is claimed is:

1. A fuel composition comprising a mixture of a major amount of hydrocarbons in the gasoline boiling range and a minor amount of an additive compound having the formula:

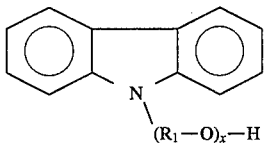

wherein each $R_1$ is independently selected from alkyl of 2 to 20 carbon atoms; x is from 4 to 50; and the weight average molecular weight of the additive compound is at least about 600.

2. The fuel composition of claim 1 wherein said additive compound is present in an amount from about 50 ppm by weight to about 400 ppm by weight based on the total weight of the fuel composition.

3. The fuel composition of claim 1 wherein each $R_1$ is hydrocarbyl of the formula:

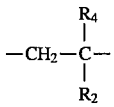

wherein each $R_2$ is independently selected from the group consisting of hydrogen and alkyl of 1 to 18 carbon atoms each $R_4$ is independently selected from the group consisting of hydrogen and alkyl of 1 to 18 carbon atoms.

4. The fuel composition of claim 3 wherein x is from 8 to 40, each $R_2$ is independently selected from the group consisting of hydrogen and alkyl of 2 carbon atoms and each $R_4$ is independently selected from the group consisting of hydrogen and alkyl of 2 carbon atoms.

5. The fuel composition of claim 1 wherein each $R_1$ is hydrocarbyl of the formula:

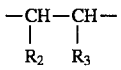

wherein each $R_2$ is independently selected from the group consisting of hydrogen and alkyl of 1 to 18 carbon atoms; each $R_3$ is independently selected from the group consisting of hydrogen and alkyl of 1 to 18 carbon atoms; and x is from 8 to 40.

6. A fuel composition comprising a mixture of a major amount of hydrocarbons in the gasoline boiling range and a minor amount of an additive compound having the formula:

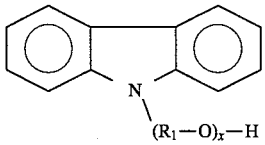

wherein each $R_1$ is hydrocarbyl of the formula:

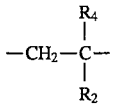

wherein each $R_2$ is independently selected from the group consisting of hydrogen and alkyl of 2 to 4 carbon atoms, each $R_4$ is independently selected from the group consisting of hydrogen and alkyl of 2 to 4 carbon atoms, x is from 10 to 22; and the weight average molecular weight of the additive compound is from about 1100 to about 1700.

7. A method for reducing intake valve deposits in an internal combustion engine which comprises burning in said engine a fuel composition comprising a major amount of hydrocarbons in the gasoline boiling range and a minor amount of a compound having the formula:

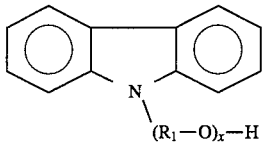

wherein each $R_1$ is independently selected from alkyl of 2 to 20 carbon atoms; x is from 4 to 50; and the weight average molecular weight of the additive compound is at least about 600.

8. The method of claim 7 wherein said additive compound is present in an amount from about 50 ppm by weight to about 400 ppm by weight based on the total weight of the fuel composition.

9. The method of claim 7 wherein each $R_1$ is hydrocarbyl of the formula:

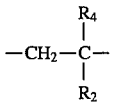

wherein each $R_2$ is independently selected from the group consisting of hydrogen and alkyl of 1 to 18 carbon atoms each $R_4$ is independently selected from the group consisting of hydrogen and alkyl of 1 to 18 carbon atoms.

10. The method of claim 9 wherein x is from 8 to 40, each $R_2$ is independently selected from the group consisting of hydrogen and alkyl of 2 carbon atoms and each $R_4$ is independently selected from the group consisting of hydrogen and alkyl of 2 carbon atoms.

11. The method of claim 7 wherein each $R_1$ is hydrocarbyl of the formula:

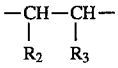

wherein each $R_2$ is independently selected from the group consisting of hydrogen and alkyl of 1 to 18 carbon atoms;

each $R_3$ is independently selected from the group consisting of hydrogen and alkyl of 1 to 18 carbon atoms; and x is from 8 to 40.

12. A method for reducing intake valve deposits in an internal combustion engine which comprises burning in said engine a fuel composition comprising a major amount of hydrocarbons in the gasoline boiling range and a minor amount of a compound having the formula:

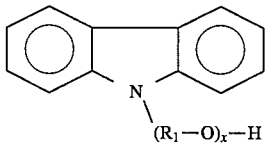

wherein each $R_1$ is hydrocarbyl of the formula:

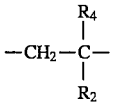

wherein each $R_2$ is independently selected from the group consisting of hydrogen and alkyl of 2 to 4 carbon atoms, each $R_4$ is independently selected from the group consisting of hydrogen and alkyl of 2 to 4 carbon atoms, x is from 10 to 22; and the weight average molecular weight of the additive compound is from about 1100 to about 1700.

* * * * *